US009402521B2

(12) United States Patent
Bassett et al.

(10) Patent No.: US 9,402,521 B2
(45) Date of Patent: Aug. 2, 2016

(54) CYCLONIC SEPARATION DEVICE

(71) Applicant: Hoover Limited, Merthyr Tydfil (GB)

(72) Inventors: Alexander Anthony Denny Bassett, Suzhou (CN); Qunli Zhao, Suzhou (CN); Xiaolong Bian, Nantong (CN)

(73) Assignee: Hoover Limited (GB)

( * ) Notice: Subject to any disclaimer, the term of this patent is extended or adjusted under 35 U.S.C. 154(b) by 0 days.

(21) Appl. No.: 14/644,042

(22) Filed: Mar. 10, 2015

(65) Prior Publication Data

US 2015/0257616 A1 Sep. 17, 2015

(30) Foreign Application Priority Data

Mar. 11, 2014 (GB) ..... 1404237.8

(51) Int. Cl.
*A47L 9/16* (2006.01)
*B04C 3/04* (2006.01)

(52) U.S. Cl.
CPC ..... *A47L 9/1608* (2013.01); *A47L 9/1616* (2013.01); *B04C 3/04* (2013.01)

(58) Field of Classification Search
CPC ... A47L 9/1616; A47L 9/1608; A47L 9/1641; A47L 9/1625; A47L 9/1675; B04C 3/04
See application file for complete search history.

(56) References Cited

U.S. PATENT DOCUMENTS 3,655,058 A * 4/1972 Novak ..... B04B 5/12 210/360.1
6,485,536 B1 * 11/2002 Masters ..... A47L 9/102 55/337
7,615,088 B2 * 11/2009 Benedictus ..... A47L 9/1608 55/337

FOREIGN PATENT DOCUMENTS

GB 2389064 A 12/2003
GB 2397785 A 8/2004
GB 2454227 A 5/2009

OTHER PUBLICATIONS

GB Intellectual Property Office, "Search Report" in GB Application No. GB1404237.8, dated Sep. 9, 2014, 1 page.

* cited by examiner

*Primary Examiner* — Dung Van Nguyen
(74) *Attorney, Agent, or Firm* — Kang S. Lim

(57) ABSTRACT

A cyclonic separation device comprises a cyclone chamber 11 having a cyclone axis A, a fluid outlet at one end of the cyclone chamber and a tubular apertured shroud 14 extending concentrically with the cyclone axis A. In use a motor 15 rotates the shroud 14 in the direction of a rotational airflow in the chamber 11 at a rotational speed which is over 1500 rpm and/or over 70% of the airflow speed around the shroud 14. The high speed of rotation of the shroud 14 is sufficient to dislodge any dust on the shroud by centrifugal action. Also, the high rotational speed of shroud 14 means that the air does not to need to decelerate to pass through the shroud 14 apertures and hence the risk of pressure drop and a loss of suction is avoided.

12 Claims, 1 Drawing Sheet

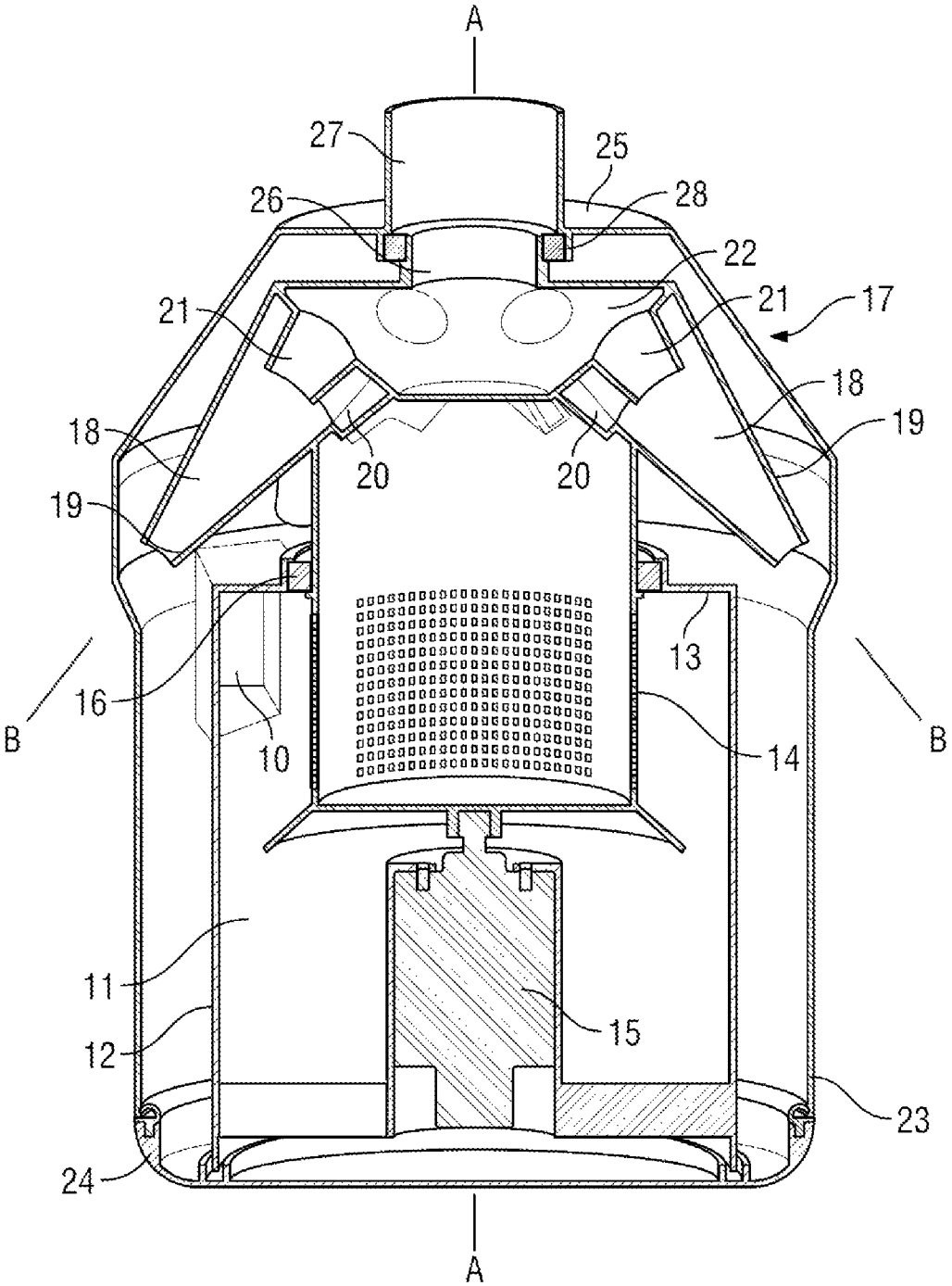
A
27
25
26
28
22
21
21
17
18
18
19
19
20
20
16
13
B
B
10
14
11
15
12
23
24
A

CYCLONIC SEPARATION DEVICE

CROSS REFERENCE TO RELATED APPLICATION

This application claims the benefit of United Kingdom Patent Application No. 1404237.8 filed Mar. 11, 2014, which application is incorporated herein in its entirety by this reference.

This application is also related to co-pending U.S. application Ser. No. 14/644,072, being filed concurrently herewith by the same inventors, of same title, which claims the benefit of United Kingdom Patent Application No. 1404229.5 filed Mar. 11, 2014, which applications are incorporated herein in their entirety by this reference.

BACKGROUND

This invention relates to a cyclonic separation device and in particularly but not solely to a cyclonic separation device for a vacuum cleaner.

Cyclonic separation devices are widely used in vacuum cleaners to separate dirt and dust from the airflow. Typically such vacuum cleaners incorporate a single upstream cyclone separator which is relatively large in diameter and which is suited to separating heavy dirt and dust particles as well as coarse and fibrous matter from the airflow.

Generally, a cylindrical shroud is mounted concentrically inside the cyclone chamber of the upstream stage such that air in the cyclone chamber rotates around the shroud and is drawn radially inwardly into the interior of the shroud through apertures which are formed in the side wall thereof. The shroud partially acts as a filter to prevent large lighter matter leaving the cyclone chamber and also acts to shape and constrain the airflow in the cyclone chamber.

A problem with such shrouds is that the apertures therein can become blocked with dirt and dust.

GB2397785 discloses a cyclonic separation device in which the partially cleaned air leaves the cyclone chamber through a rotatable shroud disposed axially within the cyclone chamber. The shroud comprises axially extending louvers which act as vanes that cause the shroud to be rotated by the induced airflow in the cyclone chamber. The document alleges that an advantage of this arrangement is that the rotary motion of the shroud dislodges any dust on the shroud by centrifugal action. A problem with this arrangement is that the speed of the shroud substantially lags behind the speed of the airflow and does not reach a significant enough speed to dislodge the dust thereon. In fact, the shroud actually acts to slow the air thereby causing a pressure drop and a loss of efficiency.

GB2389064 discloses a cyclonic separation device in which the partially cleaned air leaves the cyclone chamber through a rotatable shroud disposed axially within the cyclone chamber. The shroud is rotated at a low speed by a motor and gear train to cause the external surface of the shroud to be wiped of dust by a static brush.

Another problem with shrouds is that the rotational airflow inside the cyclone chamber of the first stage has to decelerate and turn radially inwardly to pass through the apertures, thereby causing a pressure drop and a loss of suction.

We have now devised an improved cyclone separation device.

SUMMARY

In accordance with the present invention there is provided a cyclone separation device comprising a cyclone chamber having a cyclone axis, a fluid outlet at one end of the cyclone chamber and a tubular apertured shroud extending concentrically with the cyclone axis, the device further comprising a motor for rotating the shroud in the direction of a rotational airflow in the chamber at a rotational speed which is over 1500 rpm and/or over 70% of the airflow speed around the shroud when the device is in use.

The high speed of rotation of the shroud is sufficient to dislodge any dust on the shroud by centrifugal action. Also, the high rotational speed of shroud means that the air does not to need to decelerate to pass through the shroud apertures and hence the risk of pressure drop and a loss of suction is avoided. An increase in separation efficiency is partly achieved due to the fact that the dust is always rotating and is subjected to centrifugal action. Conversely, with a static shroud the dust particles immediately in front of the shroud holes have decelerated to pass through the shroud apertures and are not subjected to centrifugal action.

The ideal relative speed between the shroud and the surrounding airflow should be the zero. A zero relative speed ensures that the pressure drop across the shroud is minimal. Firstly, the pressure drop across the shroud is affected by the degree of shear between the shroud apertures and the surrounding airflow. The greater the difference in relative speed between the shroud apertures and surrounding airflow, the greater the pressure drop. Secondly, air has a density and is also affected by centrifugal forces as it flows through the rotating shroud holes. Hence a rotational speed less than the speed of the surrounding airflow is preferred as it provides the best balance between increasing separation efficiency and increasing the pressure drop.

In one embodiment the device comprises a sensor for determining the amount of dust or other matter entering the cyclone chamber, the sensor being arranged to control the speed of the motor. If no dust or other matter is detected, then the motor preferably rotates the shroud at a higher speed. If dust is detected, then the speed of the motor is preferably increased a suitable value depending upon the amount of dust detected. This will conserve energy and maximize separation efficiency only when required.

Alternatively or additionally, the speed of the motor may be varied in accordance with the speed of the airflow.

This wall thickness of the shroud directly affects the separation efficiency and pressure drop. Preferably the wall thickness of the shroud is substantially 2.5 mm.

Large diameter cyclone separators are unable to separate lighter dirt and dust particles and hence a further separation stage is needed downstream of the cyclone separator. Preferably the cyclonic separator as hereinbefore defined forms an upstream separation stage of the device, the device further comprising a downstream separation stage.

The downstream stage may comprise a filter, a single cyclonic separator or a plurality of cyclonic separators fluidly connected in series and/or parallel. In the latter case, each cyclonic separator of the second stage preferably comprises a chamber having a circular-section side wall, a fluid inlet and a fluid outlet disposed at one end of the cyclone chamber, and an opening at the second end of the cyclone chamber through which separated matter passes out of the chamber for collection.

In use, air enters each cyclone chamber through the inlet thereof and rotates in a vertical manner around the cyclone axis inside the circular-section side wall towards the second end of the cyclone chamber. The dust particles in the rotating airflow are forced radially outwardly against the side wall under centrifugal action. The volume of rotating airflow slowly diminishes towards the second end of the cyclone chamber as air is drawn radially inwardly and axially towards the outlet at the first end of the cyclone chamber. However, the dust particles that are forced radially outwardly against the frusto-conical side wall are disposed in a boundary layer and slowly migrate towards the open second end of the cyclone chamber, whereupon they pass out of the cyclone chamber into a collection chamber.

A disadvantage of the above-mentioned arrangement is that dust particles in the boundary layer can become re-entrained in the airflow, particularly if the airflow is heavily laden with dust or if there is a drop in airflow. Also, the speed at which the dust particles migrate is slow and hence the risk of re-entrainment is increased, partly because the volume of dust in the boundary layer is so great that it forms a layer which is too wide to remain inside the boundary layer.

In order to solve the above-mentioned problems, co-pending UK patent application no. 1404229.5 filed Mar. 11, 2014, discloses a cyclonic separation device in which the cyclonic separators of the downstream stage are arranged in a rotatable body such that their respective cyclone axes are outwardly inclined relative to an axis of rotation of the body and such that the second end of each cyclone chamber is disposed radially outwardly of its first end with respect to said axis of rotation. Therefore, the body is preferably also rotated by said motor.

The motor can be positioned inside the shroud or outside the shroud, for example in a dust collection receptacle of the device. In the former case, providing the motor within the shroud increases the capacity of the dust collection receptacle of the device and reduces the noise emanating from the motor.

The apertures in the shroud may comprise holes, slots and other openings. The apertures may be provided by a mesh. The apertures may be directed in the direction of rotation of the shroud.

Also in accordance with the present invention, there is provided a vacuum cleaner having a cyclonic separation device as hereinbefore defined.

Preferably in a vacuum cleaner the shroud is rotated at a speed of up to 5000 rpm and preferably at a speed of substantially 3000 rpm, which provides an ideal balance between increasing separation efficiency and increasing the pressure drop (i.e. separation efficiency can be increased above 95% by increasing the rotational speed above 3000 rpm but this would undesirably cause a pressure drop across the shroud).

Also in accordance with the present invention there is provided a method of removing matter from an airflow, the method comprising:

a. admitting the airflow to an inlet of a cyclone separation device comprising a cyclone chamber having a cyclone axis, an outlet at one end of the cyclone chamber and a tubular apertured shroud extending concentrically with the cyclone axis;

b. energising a motor to rotate the shroud in the direction of rotational airflow in the chamber at a rotational speed which is over 1500 rpm and/or over 70% of the airflow speed around the shroud.

BRIEF DESCRIPTION OF THE DRAWINGS

An embodiment of the present invention will now be described by way of an example only and with reference to the accompanying drawing, the single FIGURE of which is a sectional view through a cyclonic separation device of a vacuum cleaner in accordance with the present invention.

DETAILED DESCRIPTION

Aspects, features and advantages of exemplary embodiments of the present invention will become better understood with regard to the following description in connection with the accompanying drawing(s). It should be apparent to those skilled in the art that the described embodiments of the present invention provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present invention as defined herein and equivalents thereto. Hence, use of absolute terms, such as, for example, "will," "will not," "shall," "shall not," "must," and "must not," are not meant to limit the scope of the present invention as the embodiments disclosed herein are merely exemplary.

Referring to the drawing, the cyclonic separation device comprises an air inlet 10 which leads tangentially into the upper end of a cyclone chamber 11 of a first separation stage through a cylindrical side wall 12 thereof. The upper end of the cyclone chamber 11 is closed by an end wall 13 which defines a circular air outlet of the first stage.

A cylindrical shroud 14 is mounted concentrically inside the cyclone chamber 11 at the upper end thereof. The shroud 14 comprises a bottom wall which is supported on the shaft of a motor 15 disposed at the bottom of the cyclone chamber 11. The shroud 14 extends upwardly through the circular air outlet in the end wall 13 and is rotationally sealed thereto by an annular seal 16.

The lower end of the shroud 14 comprises a plurality of apertures which fluidly communicate the interior of the cyclone chamber 11 with the interior of the shroud 14. The upper end of the shroud 14 is rigidly connected to the body 17 of a second separation stage. The body 17 comprises six outwardly-inclined cyclonic separators which are circumferentially arranged about an axis A of rotation of the shroud 14 and body 17. Each cyclonic separator comprises a cyclone chamber 18 having a cyclone axis B which extends radially outwardly of the rotational axis A.

Each cyclone chamber 18 is defined by a frusto-conical side wall 19 which tapers inwardly towards its radially outer end, the latter being open to define a dust outlet of the cyclone chamber 18.

The radially inner end of each cyclone chamber 18 comprises an inlet 20 which extends tangentially through its frusto-conical side wall 19. The inlets 20 communicate directly with the interior of the upper end of the shroud 14. The combined cross-sectional area of the inlets 20 is substantially equal to the cross-sectional area of the inlet 10 of the first separation stage.

The radially inner end of each cyclone chamber 18 also comprises a tubular outlet or so-called vortex finder 21 which extends axially of the cyclone chamber 18 from its inner end wall. The vortex finders 21 lead into a manifold chamber 22 at the upper end of the body 17.

The first and second separation stages are enclosed within a housing having a tubular side wall 23, an openable bottom wall 24 and a top wall 25. A tubular air outlet 26 extends axially upwardly from the manifold 22 to a tubular duct 27 provided on the upper surface of the top wall 25, the outlet 26 being rotationally journalled thereto by an annular seal 28.

In use, a negative pressure is applied to the outlet duct 27 by a motor and fan unit (not shown) disposed downstream thereof. The motor 15 is actuated to cause the shroud 14 and body 17 to rotate about the axis A at a rotational speed of between 1500 and 5000 rpm. The negative pressure draws dirt and dust laden air tangentially into the cyclone chamber 11 through the inlet 10 from a cleaning head of the cleaner. The motor 15 is arranged to rotate the shroud 14 and body 17 in the same direction as the air flows around the shroud 14 inside the cyclone chamber 11. The dirt and dust particles in the rotating airflow are forced radially outwardly against the side wall 12 of the cyclone chamber 11 under centrifugal action. The negative pressure draws the rotating airflow radially inwardly through the apertures in the shroud 14. However, since the shroud 14 is rotating at or near the rotational speed of the airflow, the air does not need to decelerate to pass through the apertures into the interior of the shroud 14. Any dirt and dust particles that accumulate on the exterior of the shroud 14 are thrown radially outwardly under centrifugal action and therefore the risk of blockage of the apertures is avoided.

The diameter of the cyclone chamber 11 is such that the airflow leaving the cyclone chamber is not fully cleaned and hence lighter dust particles pass through the apertures into the interior of the shroud 14.

The dirt and dust particles that are forced against the tubular side wall 12 of the cyclone chamber 11 slowly migrate downwardly in a boundary layer towards the bottom end of the cyclone chamber 11, whereupon they accumulate for collection.

The air entering the shroud 14 flows axially upwardly to the bottom wall of the body 17 where it is equally divided and flows tangentially into a respective cyclone chambers 18 through the inlets 20 thereof. The air inside each cyclone chamber 18 flows around the frusto-conical side wall 19 thereof towards the radially outer end of the cyclone chamber 18. The lighter dust particles in the rotating airflow are forced radially outwardly against the side wall 19 under centrifugal action. The volume of rotating airflow slowly diminishes towards the radially outer end of the cyclone chamber 18 as air is drawn inwardly and axially towards the vortex finder 21. However, the dust particles that are forced outwardly against the frusto-conical side wall move in a boundary layer towards the radially outer open end of the cyclone chamber 18. It will be appreciated that the dust particles in the boundary layer are rapidly forced radially outwardly along the cyclone axis B by virtue of the centrifugal action of the rotating body 17.

Dust particles leaving the cyclone chamber 18 are thrown radially outwardly against the tubular side wall 23 of the housing, whereupon they fall downwardly towards the bottom of the device. The bottom wall 24 can be removed to allow the separated dirt and dust particles to be removed from both the first and second stages of the device.

A vacuum cleaner in accordance with the present invention has a greatly improved separation efficiency compared with vacuum cleaners of the kind disclosed in GB2490693 even when the overall power consumption of the vacuum cleaner is reduced to comply with legislation.

While the preferred embodiment of the invention has been shown and described, it will be understood by those skilled in the art that changes of modifications may be made thereto without departing from the true spirit and scope of the invention.

What is claimed is:

1. A cyclonic separation device comprising a cyclone chamber having a cyclone axis, a fluid outlet at one end of the cyclone chamber and a tubular apertured shroud extending concentrically with the cyclone axis, the device further comprising a motor for rotating the shroud in the direction of a rotational airflow in the chamber at a rotational speed which is over 1500 rpm and/or over 70% of the airflow speed around the shroud when the device is in use.

2. A cyclonic separation device as claimed in claim 1, in which the device comprises a sensor for determining the amount of dust or other matter entering the cyclone chamber, the sensor being arranged to control the speed of the motor.

3. A cyclonic separation device as claimed in claim 2, in which the speed of rotation of the motor is increased as the detected level of dust or other matter falls and vice-versa.

4. A cyclonic separation device as claimed in claim 1, in which the device is arranged to determine the speed of airflow through the chamber and to control the speed of the motor accordingly.

5. A cyclonic separation device as claimed in claim 4, in which the speed of rotation of the motor is increased as the determined airflow speed increases and vice-versa.

6. A cyclonic separation device as claimed in claim 1, in which the wall thickness of the shroud is substantially 2.5 mm.

7. A cyclonic separation device as claimed in claim 1, in which the cyclonic separator forms an upstream separation stage of the device, the device further comprising a downstream separation stage comprising a plurality of cyclonic separators fluidly arranged in parallel with each other, each cyclonic separator comprising a chamber having a circular-section side wall, a fluid inlet and a fluid outlet disposed at one end of the cyclone chamber, and an opening at the second end of the cyclone chamber through which separated matter passes out of the chamber for collection.

8. A cyclonic separation device as claimed in claim 7, in which in which the cyclonic separators of the downstream stage are arranged in a rotatable body such that their respective cyclone axes are outwardly inclined relative to an axis of rotation of the body and such that the second end of each cyclone chamber is disposed radially outwardly of its first end with respect to said axis of rotation.

9. A cyclonic separation device as claimed in any claim 8, in which the body is rotated by said motor.

10. A cyclonic separation device as claimed in claim 9, in which the shroud and body form a unitary member.

11. A vacuum cleaner having a cyclonic separation device as claimed in claim 1.

12. A method of removing matter from an airflow, the method comprising:

a. admitting the airflow to an inlet of a cyclone separation device comprising a cyclone chamber having a cyclone axis, an outlet at one end of the cyclone chamber and a tubular apertured shroud extending concentrically with the cyclone axis; and b. energising a motor to rotate the shroud in the direction of rotational airflow in the chamber at a rotational speed which is over 1500 rpm and/or over 70% of the airflow speed around the shroud.

* * * * *